United States Patent [19]

Sutter

[11] 4,306,337

[45] Dec. 22, 1981

[54] PNEUMATIC CLEANING APPARATUS FOR THE INFEED TABLE OF A SPINNING MACHINE

[75] Inventor: Hans-peter Sutter, Uster, Switzerland

[73] Assignee: Luwa AG, Zurich, Switzerland

[21] Appl. No.: 17,620

[22] Filed: Mar. 5, 1979

[30] Foreign Application Priority Data

Mar. 15, 1978 [CH] Switzerland ..... 2810/78

[51] Int. Cl.[3] ..... D01H 5/62; D01H 5/66

[52] U.S. Cl. ..... 19/263; 19/288; 57/305

[58] Field of Search ..... 19/242, 243, 263, 288, 19/200, 262, 264, 265; 57/304, 305; 15/306 A, 308

[56] References Cited

U.S. PATENT DOCUMENTS

| | | | |
|---|---|---|---|
| 2,111,139 | 3/1938 | Carliss | 19/242 |
| 2,771,639 | 11/1956 | Aymerich | 19/288 |
| 3,020,600 | 2/1962 | West | 19/263 X |
| 3,408,698 | 11/1968 | Rosele et al. | 19/263 |
| 3,705,441 | 12/1972 | Muller et al. | 19/263 |
| 3,755,849 | 9/1973 | Fink | 57/304 X |
| 3,885,272 | 5/1975 | Marzoli | 19/263 X |
| 4,026,095 | 5/1977 | Kobatake et al. | 57/305 X |
| 4,107,911 | 8/1978 | Yamana et al. | 57/304 |

*Primary Examiner*—Louis Rimrodt

*Attorney, Agent, or Firm*—Werner W. Kleeman

[57] ABSTRACT

A pneumatic cleaning apparatus arranged at the infeed table of a spinning machine, especially a drafting arrangement, wherein the infeed table possesses a number of sliver infeed locations. Each infeed location has operatively associated therewith a pair of rolls, forming a nip, for conveying in each case a sliver from a sliver supply, for instance a can. Each infeed location further has operatively associated therewith sliver guide elements arranged neighboring the related pair of rolls. At least the sliver guide elements are operatively associated with an air conducting means operatively connected with a negative pressure source.

12 Claims, 3 Drawing Figures

PNEUMATIC CLEANING APPARATUS FOR THE INFEED TABLE OF A SPINNING MACHINE

BACKGROUND OF THE INVENTION

The present invention relates to a new and improved construction of pneumatic cleaning apparatus for the infeed table of a spinning machine.

Generally speaking, the inventive pneumatic cleaning apparatus is arranged at the infeed table of a spinning machine, especially a drafting arrangement, wherein the infeed table has a number of sliver infeed locations. Each infeed location has associated therewith a pair of rolls forming a nip for conveying an associated fiber sliver from a sliver supply, for instance a can. Further, there is operatively associated with each infeed location sliver guide elements which are arranged neighboring the related pair of rolls.

Such type cleaning apparatus should prevent the collection of dust and fly at the sliver guide elements, since such contaminants otherwise can adhere to the traveling sliver, move into the drafting arrangement along with the sliver and at that location can result in disturbances. These contaminants are paticularly released from the traveling fiber sliver at the sliver guide elements and also at the nip between the driven infeed rolls.

A heretofore known cleaning apparatus arranged at the infeed table of a high production-drafting arrangement—in other words a drafting arrangement having a high withdrawal speed of the sliver which is usually removed from sliver or spinning cans—possesses blower slots through which there effluxes air in order to blow away contaminants. Yet, with this technique the contaminants are not removed from the room, and thus, when exposed to the action of an air current can again be placed in motion and deposit upon the sliver. On the other hand, these contaminants increase the contamination of the air in the room and enter into the lungs of individuals who are active at such region. However, more recent tests have shown that, for instance, cotton dust which has been breathed-in is damaging to humans and can cause illnesses of the bronchial tract.

It is known to remove by suction dust which is formed within enclosed machines, such as for instance at the drafting arrangement. However, this is not readily possible at equipment such as an infeed table which is open for reasons of accessibility, because, as is known, by means of the suction openings there only can be sucked-up the dust which happens to just move past such suction openings. This also constitutes the reason that with the cleaning apparatuses of the state-of-the-art, there is used in one such case the techniques of blowing.

SUMMARY OF THE INVENTION

Hence, with the foregoing in mind it is a primary object of the present invention to provide a new and improved construction of pneumatic cleaning apparatus for the infeed table of a spinning machine, which is not associated with the aforementioned drawbacks and limitations of the prior art proposals.

Another and more specific object of the present invention aims at the provision of a new and improved construction of cleaning apparatus of the previously mentioned type which effectively removes the contaminants which are present in the form of dust and fly and insures for an undisturbed operation of the drafting arrangement.

Now in order to implement these and still further objects of the invention, which will become more readily apparent as the description proceeds, the cleaning apparatus of the present invention is manifested by the features that at least the sliver guide elements have operatively associated therewith an air conducting means which is connected with a negative pressure source.

Such solution is particularly advantageous because the greatest proportion of the dust and loose fibers contained in the sliver can be eliminated as fiber fly at the sliver guide elements, and such contaminants, by virtue of the proposed solution, are directly detected at their source. Since the inventive suction action is accomplished directly at the guide locations of the sliver, there is also insured that the sliver, provided that it is not torn, will also not be sucked-up in the presence of a stronger suction air current.

According to a preferred embodiment there also can be associated with the nip formed by the rolls air conducting means, in order to engage those contaminants which are released upon loading the sliver through the action of the rolls. With an appropriate arrangement the air conducting means associated with the nip can be combined with or can be identical to the air conducting means associated with the sliver guide element arranged after the rolls.

Preferably, the air conducting means, which are associated with each sliver infeed location, can possess a collecting opening connected with the negative pressure source and in which opens the partial currents of the air sucked up from the surroundings and neighboring the infeed and/or outfeed sides of the sliver guide elements. The partial currents can join together in a fan-shaped manner at such collecting opening, so that it is not necessary to provide a separate opening for each partial current.

According to a particularly preferred constructional embodiment the partial currents can be guided by a funnel-like suction head arranged beneath the horizontally extending path of the sliver. This suction head has a suction opening which is subdivided for the partial currents and downwardly directed. Such suction head can be fabricated as a unit and also can be post-installed at an existing infeed table. According to a further embodiment lateral boundary walls of the suction head, arranged essentially parallel to the path of travel of the sliver, can extend at least approximately up to the horizontal plane of the path of travel of the sliver. This arrangement can be undertaken such that the suction head surrounds the lower roll of the coacting pair of rolls. With such arrangement it is possible by means of one suction head to act upon the sliver guide elements arranged, in the direction of sliver travel, before and after the rolls as well as at the nip formed by the rolls. Since the suction head, with such arrangement, is located directly below those friction locations at which there is eliminated most of the dust and fly, there is insured that such contaminants will be acted upon by the suction head. Hence, it is almost impossible that contaminants which have been released by the friction locations and by the nip will drop down or can be blown or strewn away in another fashion.

If the sliver guide element arranged forwardly of the rolls, with respect to the direction of travel of the sliver, and possessing a guide groove, is longer than the staple length of the sliver to be processed, then it is possible to prevent lapping of the staple fibers about the sliver guide element.

If the lateral boundary wall of the suction head, and which wall faces away from the infeed table, is highly transparent, i.e., glass clear, then it is possible to immediately recognize from the outside the presence of any contaminants which have remained in the suction head, especially fly, which, under circumstances, could conceivably clog the collection opening.

The sliver guide element arranged after the rolls, in the direction of sliver travel, can be constituted by the shutoff flap or valve which shuts-off the drive of the drafting arrangement, and which serves to shut down the drive when the sliver dams-up in front of such shut-off flap or the sliver has a thickened portion.

By virtue of the arrangement of the invention there are simultaneously fulfilled a number of requirements. Firstly, the contaminants which are present are acted upon and removed at their source, so that they cannot cause any further damage. In this way there is avoided that the traveling sliver will entrain into the drafting arrangement contaminants of the type which, at that location, could result in malfunction. Moreover, the ambient air is held free of such fly and dust. Furthermore, the arrangement of the invention, is designed such that there is not impaired in any manner the handling of the sliver during its insertion.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
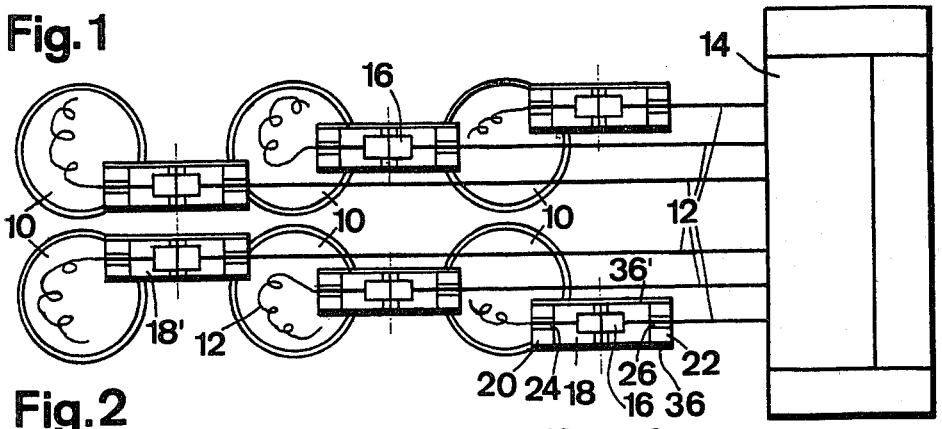
FIG. 1 is a top plan view of a pneumatic cleaning apparatus arranged at the infeed table of a drafting arrangement.
Figure 2:
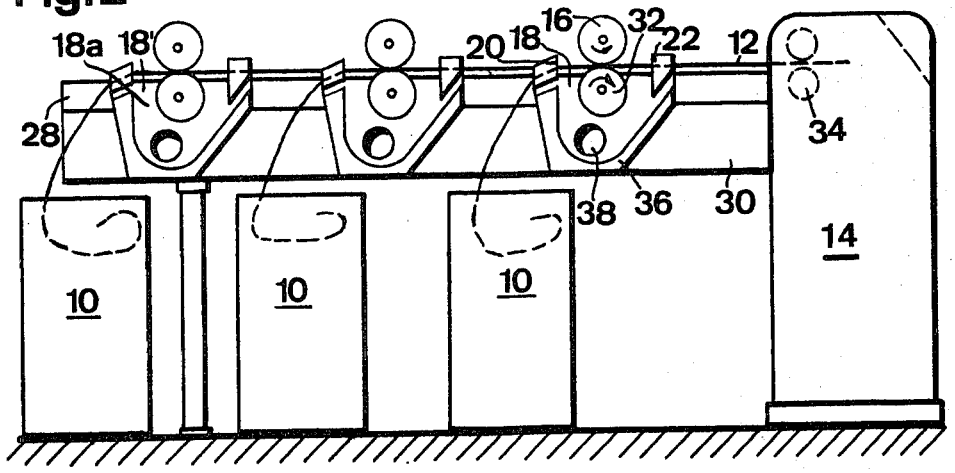
FIG. 2 is a side view of the equipment shown in FIG. 1.

Describing now to the drawings, the parts of a sliver infeed apparatus, shown by way of example in FIGS. 1 and 2, will be seen to comprise as the carrier or support an infeed or feed table 28 which has only been schematically indicated in FIG. 2 and which has been omitted completely from the showing of FIG. 1 to improve clarity of illustration. This infeed table 28 extends up to a drafting arrangement 14 throughout the region of the entire sliver infeed apparatus. By means of the sliver infeed apparatus a respective sliver 12, offered by a number of forwardly arranged sliver or spinning cans 10, is delivered to the drafting arrangement 14. The sliver infeed is accomplished by means of a respective sliver infeed location, each of which possesses a pair of rolls 16 and 32, wherein in the top plan view of FIG. 1 there is only visible the upper roll 16 of each such sliver infeed location. Below each pair of coacting rolls 16 and 32 of the sliver infeed locations there is provided a suction opening 18 whose not particularly referenced upper edge, viewed in the lengthwise direction or direction of travel of the sliver 12, is dispositioned before and after the related pair of rolls below guide elements 20 and 22 cooperating with such pair of rolls. Upwardly open guide grooves 24 and 26 are provided at such guide elements 20 and 22, respectively, these guide grooves 24 and 26 or equivalent structure serving for guiding the related sliver 12.

A suction channel 30, which likewise has only been shown in FIG. 2, extends essentially parallel to the infeed table 28 at least up to the outermost suction openings 18'. While not particularly shown for the suction channel 30, but schematically indicated in FIG. 3 for the channel 84, this suction channel 30 is operatively connected with a suitable negative pressure source, such as a vacuum pump, generally indicated schematically in FIG. 3 by reference character 100. In FIG. 2 there is also shown the lower roll 32 of each pair of coacting rolls 16 and 32, since the front side-casings or coverings, generally indicated by reference character 18*a*, of the air suction openings 18, 18' are advantageously formed of any suitable glass clear or transparent material. The slivers 12 which travel horizontally and essentially parallel to one another are drawn into the drafting arrangement 14 by means of drawing-in rolls 34 arranged within such drafting arrangement 14.

Continuing, the air suction openings 18, 18' will be seen to possess at their longitudinal sides, in the direction of the openings neighboring the slivers 12, essentially funnel-shaped, widened boundary walls 36 and 36', as best seen by referring to FIGS. 1 and 2. The air suction openings 18, 18' open by means of a respective related suction-collection opening 38 into the common suction channel 30. Through the suction channel 30 there is entrainably guided in the direction of the drafting arrangement 14 the sucked-off air and the fiber fly and dust which has been detached from the slivers 12 at the corresponding guide elements 20 and 22 and the related pairs of rolls 16 and 32.

Figure 3:
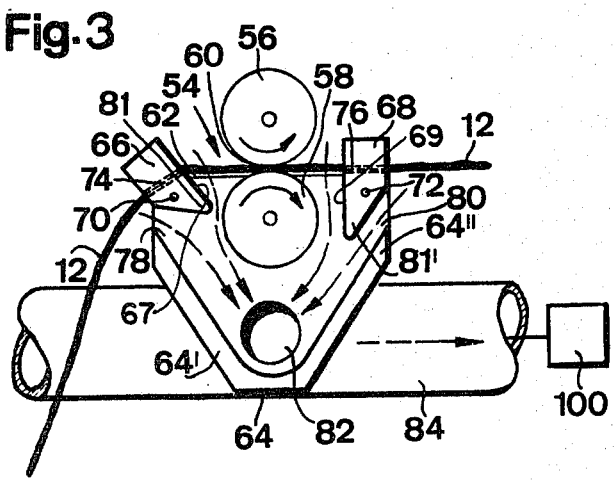
FIG. 3 illustrates on an enlarged scale details of a sliver infeed location.

Now in FIG. 3 there is shown a single one of the sliver infeed locations portrayed in FIGS. 1 and 2, however on an enlarged scale and in a somewhat different modification. This sliver infeed location will be seen to comprise a suction opening 54. The side wall 64 which confronts the observer of the drawing of FIG. 3 is transparent. A roll pair composed of an upper roll 56 and a lower, driven roll 58 is arranged approximately at the center of the opening 54 with respect to the lengthwise extent of such opening in the direction of travel of the sliver 12. The nip 60 formed between the rolls 56 and 58 and serving to convey the related sliver 12 is located approximately at the height of the upper edge 62 of the boundary wall 64 or slightly above such boundary wall.

Viewed in the direction of travel of the sliver 12 there is pivotably arranged about a respective pivot shaft 70 and 72 a respective guide element 66 and 68 before and after the pair of rolls 56 and 58. The guide elements 66 and 68 each have an upwardly open guide groove 74 and 76, respectively, for laterally guiding the sliver 12. The broken arrows show the partial air currents of the upwardly directed suction opening 54 which is subdivided by the guide elements 66 and 68 and the pair of rolls 56 and 58. In the direction of flow the guide elements 66 and 68 possess essentially wedge-shaped, tapered projections 81 and 81', respectively.

The guide faces 67 and 69, constituting additional air conducting means, of the guide elements 66 and 68 conduct additional air past the silver adjacent the rolls 56 and 58 and in the vicinity of the nip of such rolls.

The guide element 66 which is arranged, in the direction of conveying of the sliver 12, forwardly of the pair of rolls 56 and 58, is pivoted in counter clockwise direction about its pivot shaft 70 in the illustration of FIG. 3, so that its guide groove 74 extends downwardly at an inclination in the direction of the related sliver can which has not been particularly illustrated in FIG. 3. This guide element 66 can however also be adjusted such that its guide groove 74 is inclined, with respect to the horizontal, only through an angle of about 15°, so that the larger kink or bend of the sliver is located forwardly of such guide element 66. Further, as will be apparent from the showing of FIG. 3, by rocking the guide element 66 about its pivot shaft 70 it is possible to oppositely influence in cross-section the suction-partial opening 78 between the guide element 66 and the boundary wall 64' as well as the suction-partial opening between the guide element 66 and the lower roll 58.

On the other hand, the guide groove 76 or equivalent structure provided at the other guide element 68 extends essentially in horizontal direction. Between the guide element 68 and the wall portion 64'' there is formed a suction gap or slot 80 which likewise forms a part of the suction opening 54.

By virtue of the arrangement shown in FIG. 3 the contaminants which are capable of flying are sucked-off at the region in front and behind each of the guide elements 66 and 68, and thus, also before and after the pair of rolls 56 and 58. The partial currents illustrated by the broken line arrows open in a fan-like fashion into the suction-collecting or collection opening 82 which, in turn, opens into the air channel 84 which is operatively connected with the aforementioned negative pressure source 100.

Among other things, the sucked-up air wipingly contacts the outer surfaces of the respective coacting pairs of rolls 16, 32 and 56, 58 at an essentially right-angle with respect to the sliver 12, so that also waste composed of fiber fly and dust, released due to the squeezing action of the sliver 12 between such rolls, is entrained. By appropriately dimensioning the suction cross-sectional area and the negative pressure the air current is adjusted such that not only are the guide elements 20, 22 and 66, 68 and the pairs of rolls 16, 32 and 56, 58 cleaned, but also the sliver 12, but without damaging such sliver.

Generally, air is sucked-up from the surroundings through the suction openings 18, 18' and 54. This air, in the case of spinning mills, usually is climatized ambient air which, as concerns its temperature and its moisture content, possesses predetermined and constantly maintained values. In order to be able to influence the sliver 12 particularly as concerns its moisture content, it is also possible to infeed to the suction openings, by means of additional air channels, a suitable quantity of prepared or conditioned air, whose properties can deviate from that of the ambient air.

The sliver 12 which is withdrawn out of its spinning can 10, particularly when it is removed at a large withdrawal speed of, for instance, 1 meter per second, oscillates over such spinning can in a balloon-like configuration. Owing to this movement of the sliver 12 there are detached thereat a large quantity of dust and fly, which after settling can be eliminated at the infeed side of the first guide element 66 (FIG. 3). Therefore, it is particularly of importance that the infeed side of the first guide element 66 already has operatively associated therewith a partial current of the air which is to be sucked-off.

While there are shown and described present preferred embodiments of the invention, it is to be distinctly understood that the invention is not limited thereto, but may be otherwise variously embodied and practiced within the scope of the following claims. Accordingly,

What I claim is:

1. A pneumatic cleaning apparatus arranged at an infeed table of a spinning machine, especially a drafting arrangement, comprising:

means defining a number of sliver infeed locations at the region of the infeed table;

said means defining said number of sliver infeed locations comprising for each infeed location:

a pair of cooperating rolls forming therebetween a nip for conveying a related sliver received from a sliver supply and having an inlet side and an outlet side;

a pair of sliver guide elements associated with said pair of rolls, one sliver guide element of said pair being arranged at said inlet side and the other sliver guide element of said pair being arranged at said outlet side, each of said sliver guide elements defining an upwardly open guide groove and being spaced from said pair of rolls;

air conducting means for conducting air at each of the sliver infeed locations;

negative pressure source means operatively connected with said air conducting means; and at least said sliver guide elements being operatively associated with said air conducting means.

2. The pneumatic cleaning apparatus as defined in claim 1, further including:

sliver supply means for feeding a sliver to each sliver infeed location.

3. The pneumatic cleaning apparatus as defined in claim 2, wherein:

said sliver supply means comprises at least one sliver can.

4. The pneumatic cleaning apparatus as defined in claim 1, further including:

additional air conducting means operatively associated with said nip of the coacting pairs of rolls and connected with said source of negative pressure.

5. The pneumatic cleaning apparatus as defined in claim 1, wherein:

said air conducting means of each sliver infeed location possesses a collecting opening operatively connected with said negative pressure source;

said sliver guide elements of the related sliver infeed location having an infeed side and an outfeed side; and partial currents of air sucked-up from the surroundings and neighboring at least any one of the infeed side or the outfeed side of the sliver guide elements opening into said collecting opening.

6. The pneumatic cleaning apparatus as defined in claim 5, wherein:

each of said air conducting means comprises an essentially funnel-shaped suction head means arranged below an essentially horizontally extending path of travel of the related sliver and through which there are guided the partial currents; and said suction head means having a suction opening which is upwardly directed and is subdivided for the partial currents.

7. The pneumatic cleaning apparatus as defined in claim 6, wherein:

said suction head means comprises boundary walls arranged essentially laterally of and parallel to the path of travel of the related sliver;

said boundary wall means of said suction head means extending at least approximately up to the horizontal plane of the path of travel of the sliver.

8. The pneumatic cleaning apparatus as defined in claim 7, wherein:

each pair of rolls defines an upper roll and a lower roll; and said suction head means surrounding the lower roll of the related pair of rolls.

9. The pneumatic cleaning apparatus as defined in claim 7, wherein:

said lateral boundary wall means face away from the infeed table and are transparent.

10. The pneumatic cleaning apparatus as defined in claim 1, wherein:

each of the slivers moves in a predetermined path of travel;

the sliver guide element for each sliver infeed location and which sliver guide element is arranged in front of the related pair of rolls, viewed in the direction of travel of the related sliver, possesses a guide groove which is longer than the staple length of the sliver to be processed.

11. The pneumatic cleaning apparatus as defined in claim 1, further including:

infeed conduit means operatively connected with an air climatizing installation and opening into a suction region of a suction opening of the related sliver infeed location, in order to directly infeed at least part of the air which is to be sucked-off.

12. A pneumatic cleaning apparatus arranged at an infeed table of a spinning machine, especially a drafting arrangement, comprising:

means defining a number of sliver infeed locations at the region of the infeed table;

said means defining said number of sliver infeed locations comprising for each infeed location;

a pair of cooperating rolls forming therebetween a nip for conveying a related sliver received from a sliver supply;

sliver guide elements arranged neighboring said pair of rolls;

sliver supply means for feeding a sliver to each sliver infeed location, said sliver supply means comprising at least one sliver can;

air conducting means for conducting air at each of the sliver infeed locations in a direction substantially transversely to and across the path of travel of the sliver;

negative pressure source means operatively connected with said air conducting means; and at least said sliver guide elements being operatively associated with said air conducting means.

* * * * *